United States Patent [19]

Bopp

[11] 4,365,592

[45] Dec. 28, 1982

[54] FAN DRIVE ACTUATOR

[75] Inventor: Warren G. Bopp, Farmington Hills, Mich.

[73] Assignee: Eaton Corporation, Cleveland, Ohio

[21] Appl. No.: 88,217

[22] Filed: Oct. 24, 1979

[51] Int. Cl.[3] ..... F01D 7/02

[52] U.S. Cl. ..... 123/41.12; 192/82 T

[58] Field of Search ..... 123/41.11, 41.12, 142.5 R, 123/41.02, 41.05; 165/51; 192/82 T; 236/35, DIG. 9

[56] References Cited

U.S. PATENT DOCUMENTS

| | | | |
|---|---|---|---|
| 1,357,598 | 11/1920 | Thompson | 123/142.5 R |
| 1,873,379 | 8/1932 | Frentzel, Jr. | 123/142.5 R |
| 2,381,567 | 8/1945 | Bonham | 123/41.12 |
| 2,638,881 | 5/1953 | Pankuch et al. | 123/41.05 |
| 3,207,279 | 9/1965 | Ahlen | 192/82 T |
| 3,522,795 | 8/1970 | Seifert | 123/41.12 |
| 3,809,197 | 5/1974 | Clancey | 192/82 T |
| 4,007,819 | 2/1977 | Maci | 192/82 T |

*Primary Examiner*—Craig R. Feinberg
*Assistant Examiner*—W. R. Wolfe
*Attorney, Agent, or Firm*—C. H. Grace; P. S. Rulon; F. M. Sajovec

[57] ABSTRACT

A fan drive for the cooling fan of an internal combustion motor vehicle in which the temperature of the engine coolant is constantly sensed and, in response to a sensed predetermined coolant temperature, heated air is directed by a blower through a conduit from a heat sink adjacent the exhaust manifold to the temperature sensing element of the fan drive. The heated air impacting on the temperature sensing element causes the element to react in a sense to engage the fan drive and cool the coolant.

8 Claims, 3 Drawing Figures

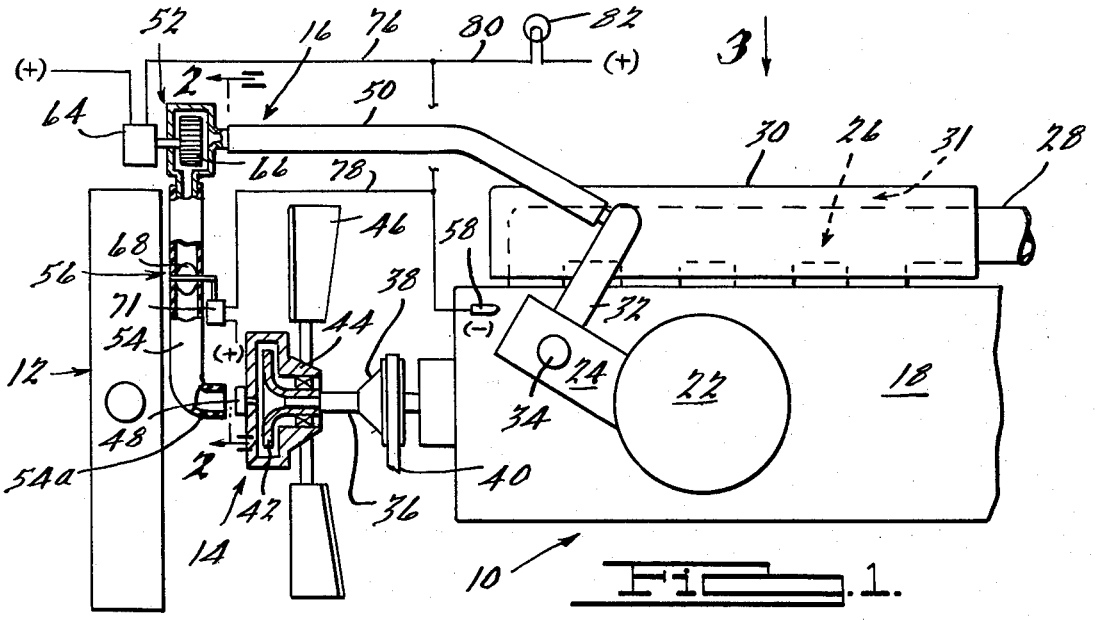
FIG. 1.
FIG. 2.
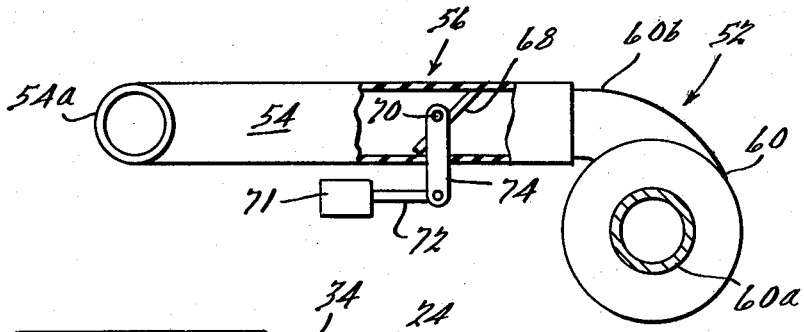
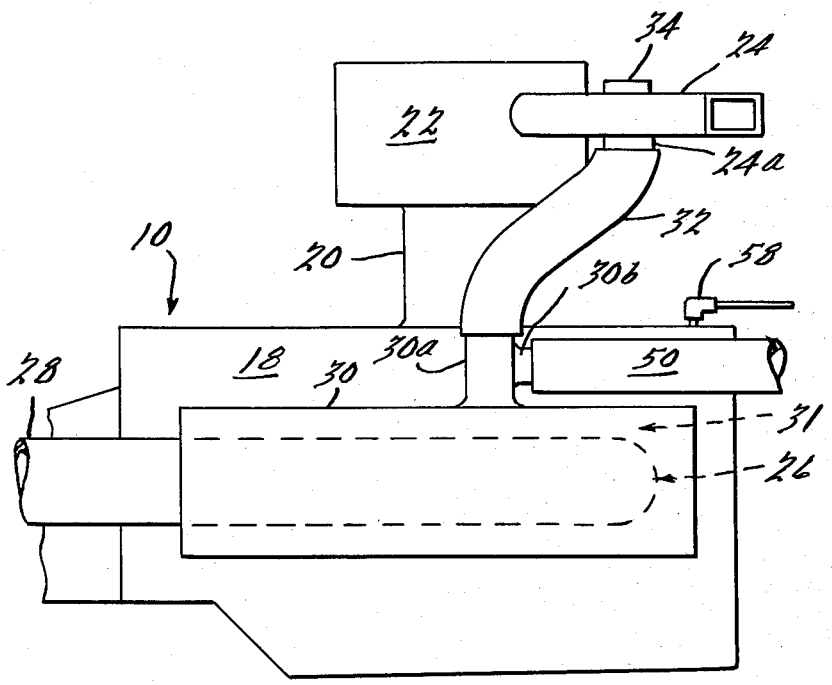
FIG. 3.

FAN DRIVE ACTUATOR

BACKGROUND OF THE INVENTION

This invention relates to fan drives for motor vehicles and, more particularly, to an improved actuator for a motor vehicular fan drive.

Fan drives for driving the cooling fan of an internal combustion engine are well-known. See, for example, U.S. Pat. No. 3,809,197. Typically, such drives include input and output members which have interdigitated portions or lands and grooves which are spaced closely adjacent each other with a fluid shear medium positioned in the space therebetween. The fluid shear medium functions to transmit the drive from the input member to the output member on which the fan is mounted. The extent to which the fan drive is engaged is dependent on the amount of viscous fluid present in the space between the input and output members and the amount of fluid is controlled by a temperature control valve device. The temperature control valve device includes a temperature sensing element, such for example as a coil spring bimetallic element, disposed at the front of the fan drive in a position to be influenced by the air passing through the radiator of the vehicle. Briefly, when the temperature of the air passing through the radiator is relatively cool, the fan drive is disengaged. When the air temperature passing through the radiator increases to a predetermined value, the temperature sensing element functions to actuate the temperature control valve to pass additional fluid to the space between the clutch members to thereby effect engagement of the fan drive and drive the fan to cool the engine coolant.

Whereas this arrangement is generally satisfactory, it embodies an inherent operational inaccuracy since the temperature of the air impacting the temperature sensing element is typically significantly different than the temperature of the coolant in the radiator. Whereas the temperature at which the temperature sensing element is actuated may be adjusted to accommodate this difference, the adjustment would have to be different for different operating conditions of the same vehicle so that the described arrangement can, at best, be calibrated to be accurate over only a portion of the range of operating conditions encountered by the vehicle. To eliminate this inaccuracy, it has been proposed to sense the temperature of the engine coolant directly and engage the fan drive upon the sensing of a predetermined coolant temperature. However, all such direct coolant temperature sensing systems heretofore proposed have been relatively complex and expensive and/or have necessitated a major redesign of the basic viscous fan drive system.

SUMMARY OF THE INVENTION

Accordingly, it is an object of the present invention to provide a fan drive system that is directly responsive to engine coolant temperature and yet is compatible with existing fan drive technology.

A more specific object is to provide an actuator for a viscous fan drive which actuates the fan drive in direct response to engine coolant temperature and does not require modification of the existing viscous fan drive structure.

The invention actuator is intended for use with an engine system of the type including an internal combustion engine having cooling passages containing liquid coolant, a radiator adapted to receive and cool the coolant, a cooling fan disposed adjacent the radiator, a fan drive drivingly interconnecting the engine and the fan, and a sensor mechanism operative in response to a predetermined ambient air temperature to cause engagement of the fan drive to drive the fan and cool the coolant. According to an important feature of the invention, the actuator includes means for sensing the temperature of the coolant and means operative in response to a predetermined sensed coolant temperature to direct air from a source of heated air adjacent the engine to the vicinity of the sensor mechanism, whereby to actuate the sensor mechanism and engage the fan drive to drive the cooling fan. This arrangement has the advantage of engaging the fan drive in direct response to sensed coolant temperature while totally preserving the existing viscous fan drive mechanism.

In the preferred embodiment of the invention, the heated air source comprises a heat sink defined adjacent the exhaust manifold of the engine, a conduit extends from the heat sink to the vicinity of the sensor mechanism, and a blower is provided in the conduit which is actuated in response to sensing of the predetermined engine coolant temperature to direct a positive stream of heated air at the sensor mechanism. This arrangement provides a quick, positive system response and yet is extremely simple in structure and operation and constitutes a ready add-on to existing and known engine and fan drive structure.

These and other objects, features, and advantages of the invention will become apparent from the following detailed description of a preferred embodiment of the invention and from the accompanying drawing.

BRIEF DESCRIPTION OF THE DRAWINGS

FIG. 1 is a top view of an engine system employing the fan drive actuator of the present invention;

FIG. 2 is partially fragmentary cross-sectional view taken on line 2—2 of FIG. 1; and FIG. 3 is partially fragmentary view looking in the direction of the arrow 3 in FIG. 1.

DESCRIPTION OF THE PREFERRED EMBODIMENT

The illustrated engine system includes an internal combustion engine 10, a radiator 12, a fan drive 14, and a fan drive actuator seen generally at 16.

Engine 10 is seen schematically and includes a block 18 containing internal cooling passages or jackets (not shown) for circulating a coolant; a carburetor 20; an air cleaner 22 having a snorkel 24; an exhaust manifold 26 feeding combustion products to an exhaust pipe 28; a jacket 30 formed as a sheet metal stamping and surrounding manifold 26 to trap heat emanating from the manifold and create a heat sink 31 around the manifold; a flexible heat pipe 32 fitted at its lower end over a fitting **30*a* formed integral with jacket 30 and fitted at its upper end over a fitting 24*a* formed integral with snorkel 24; a vacuum actuator 34 controlling a valve (not shown) in snorkel 24 and operative to direct preheated air to carburetor 20 from heat sink 31 during engine warm-up and thereafter direct cool outside air to the carburetor; and an accessory shaft 36 including a pulley 38 driven by a belt 40** driven by the engine crankshaft.

Radiator 12 is positioned in front of engine 10 and receives and cools coolant from engine 10 in known fashion.

Fan drive 14 is carried on the free or forward end of accessory shaft 36 and includes an input member 42 fixedly secured to shaft 36, an output member 44 journaled on input member 42, a fan 46 fixedly secured to output member 44, and a temperature sensing element 48 carried on the forward face of output member 44. Element 48 comprises a bimetallic coil spring mounted on a central shaft. The shaft of element 48 controls an internal valve mechanism (not shown) which in turn regulates the amount of fluid in the space between the input and output members and thereby the extent to which the output member is driven by the input member. Broadly considered, element 48 senses changes in ambient temperature and selectively rotates its central shaft in response to such changes to selectively regulate the valve mechanism and selectively control the extent to which the fan is driven. Further details of the fan drive are shown in U.S. Pat. No. 3,809,197.

The present invention primarily concerns the fan drive actuator mechanism seen generally at 16. Actuator mechanism 16 functions to direct heated air from heat sink 31 to temperature sensing element 48 in response to a predetermined engine coolant temperature. Mechanism 16 includes a hose or conduit 50, a blower 52, a hose or conduit 54, a valve mechanism 56, and a coolant temperature sensing switch 58.

Hose 50, preferably formed of a heat resistant plastic material, is fitted at its rearward end over a fitting **30*b* formed integral with fitting 30*a* of jacket 30 and is fitted at its forward end over a central fitting 60*a* formed integral with the housing 60 of blower 52**.

Blower 52 includes a small D.C. motor 64 driving a "squirrel cage" type impeller 66 journaled in blower housing 60.

Hose 54, preferably formed of the same heat resistant plastic as hose 50, is fitted at one end over a tangential fitting **60*b* formed integral with blower housing 60 and extends therefrom transversely across the rear face of radiator 12 to the central longitudinal axis of the engine system where it terminates in an elbow portion 54*a* opening immediately in front of temperature sensing element 48**.

Valve mechanism 56 includes a flapper 68 journaled in hose 54 on a shaft 70 and a solenoid 71 having a central shaft or plunger 72 drivingly connected to flapper shaft 70 by a crank member 74 pivotally secured to the free end of plunger 72 and fixedly secured to flapper shaft 70. Flapper 68 closes hose 54 when solenoid 71 is deenergized and moves to a position opening hose 54 when solenoid 71 is energized.

Coolant temperature sensing switch 58 is mounted in engine block 18 and communicates at its lower end with the coolant in the coolant passages of the block. Switch 58 may take any of several known forms and, for example, may be constituted by the coolant temperature sensing switch already present in most motor vehicles as the actuator switch for the overheat warning light on the instrument panel.

Switch 58 is arranged as part of an electrical circuit that includes a circuit portion 76 connected to motor 64 of blower 52; a parallel circuit portion 78 connected to solenoid 71 of valve mechanism 56; and another parallel circuit portion 80 connected to the overheat warning light 82 mounted on the instrument panel of the associated vehicle. All three circuit portions pass through and are completed by switch 58 with block 18 providing the negative or ground for all three circuit portions. Switch 58 may, for example, be calibrated to close upon the sensing of an engine coolant temperature of 230° F.

In so long as the engine coolant temperature remains below 230° F., the invention actuator is inoperative. Specifically, flapper 68 remains in a position closing hose 54, blower 52 is dormant, light 82 remains off, and fan 46 remains essentially inactive. When the coolant temperature reaches 230° F., switch 58 closes to complete circuits 76, 78 and 80 and respectively turn on blower 52, open flapper 68, and light bulb 82. Heated air from heat sink 31 is thus drawn through hose 50 and directed through hose 54 against temperature sensing device 48. The air in heat sink 31, with a warm engine, will range between 300° and 350° F.; the air delivered to element 48 through 50 and 54 will be somewhat below that temperature due to line losses. The heated air delivered against element 48 will cause the element to react to effect a rotation of its central shaft to in turn move the internal valve mechanism to a position where there is a net gain of viscous fluid in the space between the input and output members of the fan drive, whereby to cause the fan to be driven. The fan will continue to be driven until the coolant temperature, as sensed by switch 58, drops a predetermined amount below 230° F., whereupon switch 58 will open, breaking circuits 76, 78 and 80 and respectively turning off blower 52, closing flapper 68, and extinguishing light 82. This cuts off the flow of heated air to element 48, causing the element to cool and effect a rotation of its central shaft in a direction to move the internal valve mechanism to a position where there is a net loss of viscous fluid in the space between the input and output members of the fan drive whereby to substantially reduce the speed at which the fan is driven.

The invention actuator will be seen to provide a positive, fast-acting means of turning the fan drive on and off in direct response to coolant temperature. And the disclosed actuator accomplishes its direct coolant temperature control of the fan drive without need for modification of existing viscous fan drive structures.

Whereas a preferred embodiment of the invention has been illustrated and described in detail, it will be apparent that various changes may be made in the preferred embodiment without departing from the scope or spirit of the invention. For example, the invention actuator has been described, in its preferred embodiment, as including both a blower mechanism 52 and a valving mechanism 56 with the blower functioning to direct a positive flow of heated air against the temperature responsive circuit and the valve mechanism functioning upon opening of switch 58 to close off pipe 54 and prevent "run-on" of the fan drive due to heated air continuing to be sucked through pipes 50 and 54 following shutdown of the blower. However, the invention can also be practiced, in given installations, with either the blower mechanism alone or the valving mechanism alone. In installations where only the blower is used, the blower provides the means for positively directing heated air from the exhaust manifold heat sink to the temperature sensing element. In installations where only the valving element is used, the valving element, and specifically the flapper of the valving element, provides the means for directing heated air from the exhaust manifold heat sink to the temperature sensing element. The flow of heated air through the conduit means in this latter instance would be augmented by the suction created by the fan which, even with the invention actuator in an "off" condition, tends to continue to rotate albeit at a relatively low speed.

What is claimed is:

1. A fan drive actuator for use with an engine system of the type including an internal combustion engine having cooling passages containing liquid coolant, an exhaust manifold, a jacket structure surrounding at least a portion of the exhaust manifold to create a heat sink, a carburetor, an air cleaner arranged to deliver air to the carburetor, means for selectively delivering preheated air to the air cleaner from the heat sink, a radiator, a fan drive drivingly interconnecting the engine and the fan, and a sensor mechanism operative in response to a predetermined ambient air temperature to cause engagement of the fan drive to drive the fan and cool the coolant; said actuator including A. a thermostatic switch arranged to sense the temperature of the engine coolant;

B. conduit means arranged to extend from the heat sink to the vicinity of the sensor mechanism;

C. means operative in response to the sensing of a predetermined coolant temperature by said switch to complete an electrical circuit; and D. means operative in response to completion of said circuit to direct heated air from the heat sink through said conduit means to the vicinity of the sensor mechanism, whereby to raise the temperature of the ambient air adjacent the sensor mechanism to said predetermined ambient air temperature and thereby operate the sensor mechanism and engage the fan drive to drive the cooling fan.

2. A fan drive actuator for use with an engine system of the type including an internal combustion engine having cooling passages containing liquid coolant, a radiator adapted to receive and cool the coolant, a cooling fan disposed adjacent the radiator, a fan drive drivingly interconnecting the engine and the fan, a sensor mechanism operative in response to a predetermined ambient air temperature to cause engagement of the fan drive to drive the fan and cool the coolant, and means defining a source of heated air adjacent an engine system component heated by the combustion products of the engine; said actuator including:

(A) means for sensing the temperature of the coolant; and (B) means, including conduit means extending from said heated air source to the vicinity of the sensor mechanism and blower means operative when actuated to direct heated air through said conduit means, operative in response to a predetermined sensed coolant temperature to raise the temperature of the ambient air adjacent the sensor mechanism to said predetermined ambient air temperature by actuating said blower means to direct heated air through said conduit means from the heated air source to the vicinity of the sensor mechanism, whereby to operate the sensor mechanism and engage the fan drive to drive the cooling fan.

3. A fan drive actuator for use with an engine system of the type including an internal combustion engine having cooling passages containing liquid coolant, a radiator adapted to receive and cool the coolant, a cooling fan disposed adjacent the radiator, a fan drive drivingly interconnecting the engine and the fan, a sensor mechanism operative in response to a predetermined ambient air temperature to cause engagement of the fan drive to drive the fan and cool the coolant, and means defining a source of heated air adjacent the exhaust manifold of the engine; said actuator including:

A. means for sensing the temperature of the coolant; and

B. means operative in response to a predetermined sensed coolant temperature to direct heated air from the vicinity of the exhaust manifold to the vicinity of the sensor mechanism, whereby to raise the temperature of the ambient air adjacent the sensor mechanism to said predetermined ambient air temperature and thereby operate the sensor mechanism and engage the fan drive to drive the cooling fan.

4. A fan drive actuator according to claim 3 wherein

E. the exhaust system includes a jacket structure surrounding at least a portion of the exhaust manifold to trap heat emanating from the exhaust manifold and create a heat sink and F. said operative means is arranged to direct heated air from the heat sink to the sensor mechanism.

5. A fan drive according to claim 3 wherein

E. said operative means includes (1) conduit means adapted to extend from the exhaust manifold to the vicinity of the sensor mechanism;

(2) a valve member in said conduit;

(3) valve control means operative to move said valve member between open and closed positions respectively opening and closing said conduit means; and (4) an electrical circuit including said valve control means; and F. said coolant temperature sensing means comprises a switch in said circuit in communication with the engine coolant and operative to complete said circuit and activate said valve control means in response to said predetermined sensed coolant temperature.

6. A fan drive actuator according to claim 8 wherein

E. said operative means includes (1) conduit means adapted to extend from the vicinity of the exhaust manifold to the vicinity of the sensor mechanism;

(2) a blower in said conduit means, including an electric motor and an impeller member driven by said motor, arranged to force heated air through said conduit means; and (3) an electrical circuit including said motor; and F. said coolant temperature sensing means comprises a switch in said circuit in communication with the engine coolant and operative to complete said circuit in response to said predetermined sensed coolant temperature.

7. A fan drive actuator according to claim 6 wherein

G. said operative means further includes (1) a valve in said conduit means and (2) valve control means operative in response to completion of said circuit to open said valve and allow heated air to be forced therethrough by said blower.

8. A fan drive actuator according to claim 7 wherein

H. said valve is located in said conduit means between said blower and the sensor mechanism and I. said valve control means includes a solenoid in said circuit.

* * * * *